US005970523A

United States Patent [19]

Atkins

[11] Patent Number: 5,970,523

[45] Date of Patent: Oct. 26, 1999

[54] LIQUID DISPENSER FOR CARRYING ON A HEAD

[76] Inventor: Herman Dewayne Atkins, 1401 N. Lamb Blvd. #293, Las Vegas, Nev. 89110

[21] Appl. No.: 08/936,950

[22] Filed: Sep. 25, 1997

[51] Int. Cl.[6] ..... A42B 1/00

[52] U.S. Cl. ..... 2/209.13; 2/195.1; 222/175

[58] Field of Search ..... 2/7, 181, 182.1, 2/182.3, 182.7, 195.1, 209.13; 222/175; 224/181; 446/27

[56] References Cited

U.S. PATENT DOCUMENTS 1,021,323 3/1912 McMurtry ..... 2/209.13

*Primary Examiner*—Diana L. Oleksa

[57] ABSTRACT

A new liquid dispenser for carrying on a head for the purpose of allowing a user to partake of a liquid without the use of their hands. The inventive device includes a hat with an inner layer and outer layer defining a reservoir for holding a liquid. A tubing is coupled to the hat and in fluid communication with the reservoir. The liquid dispenser for carrying on a head is designed to be worn on a person's head allowing the tubing to be inserted into the wearer's mouth for drawing a liquid from the reservoir.

11 Claims, 4 Drawing Sheets

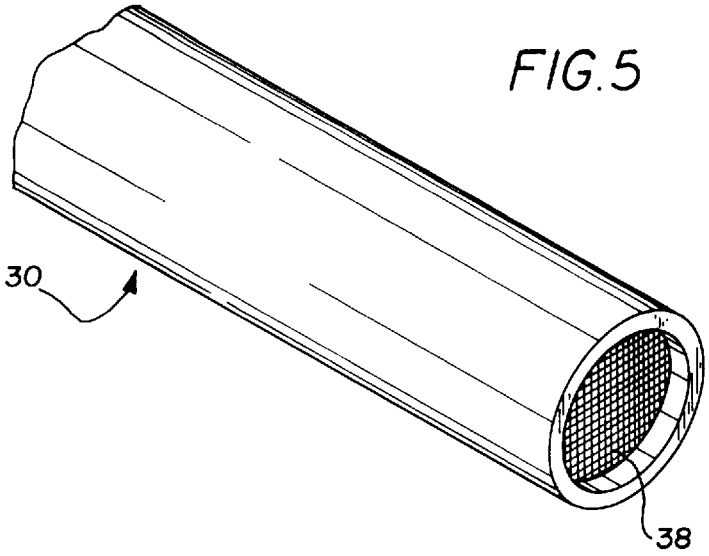
FIG.5
FIG.6
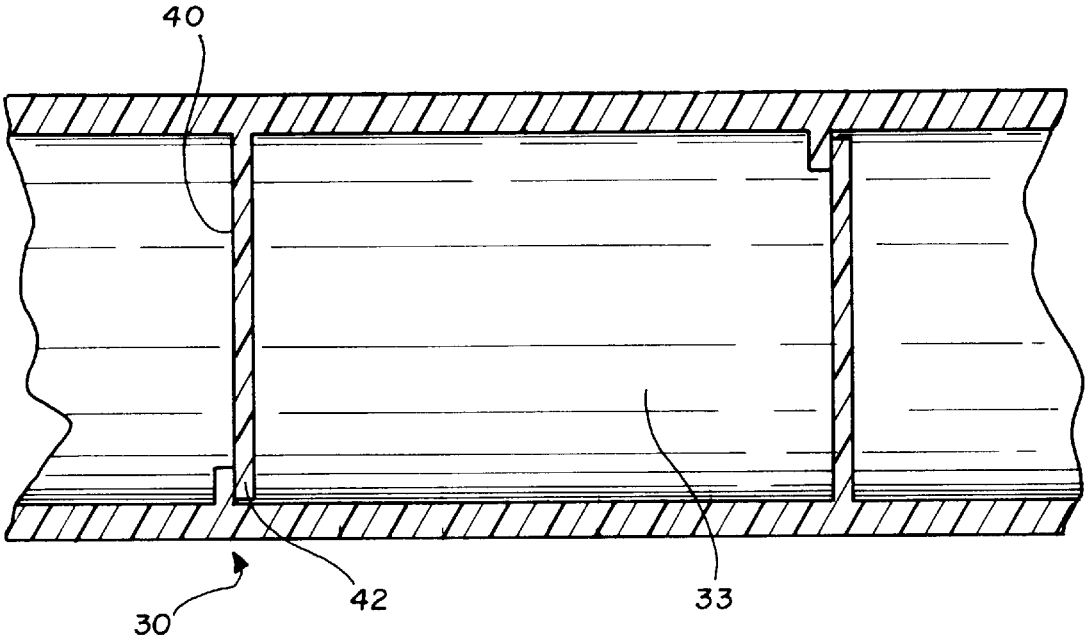

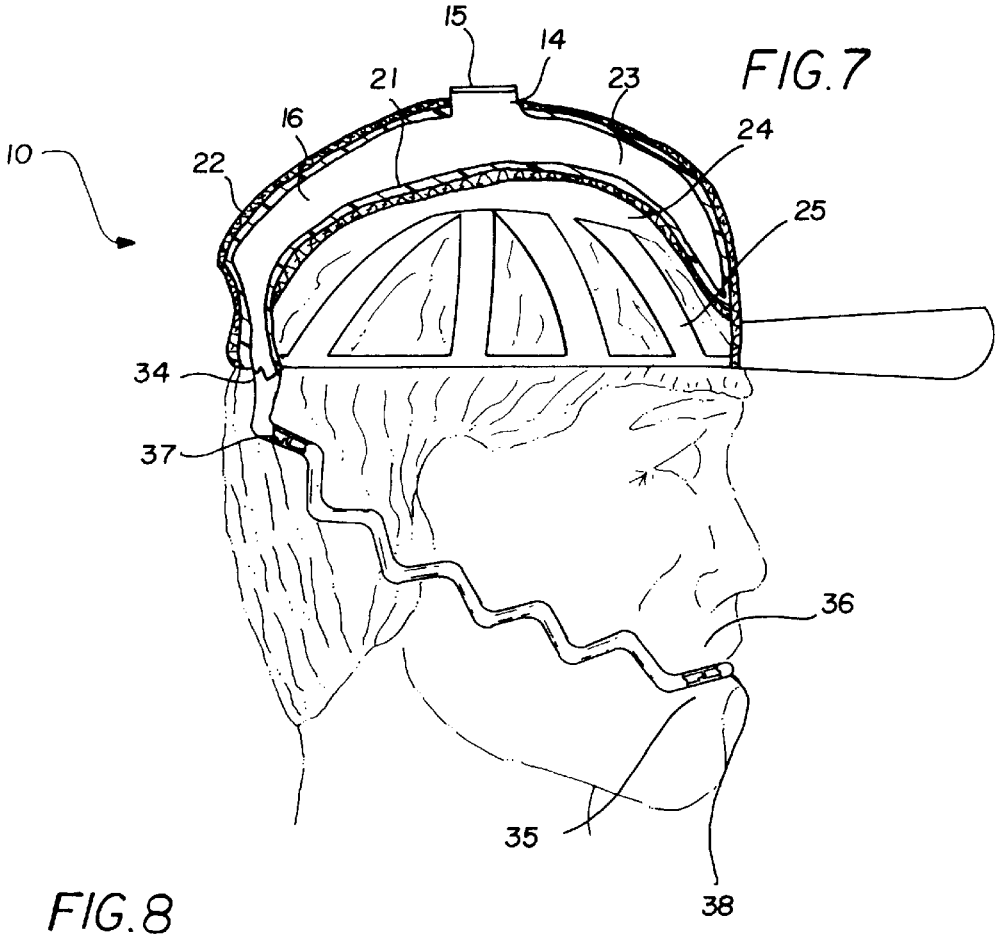
FIG.8
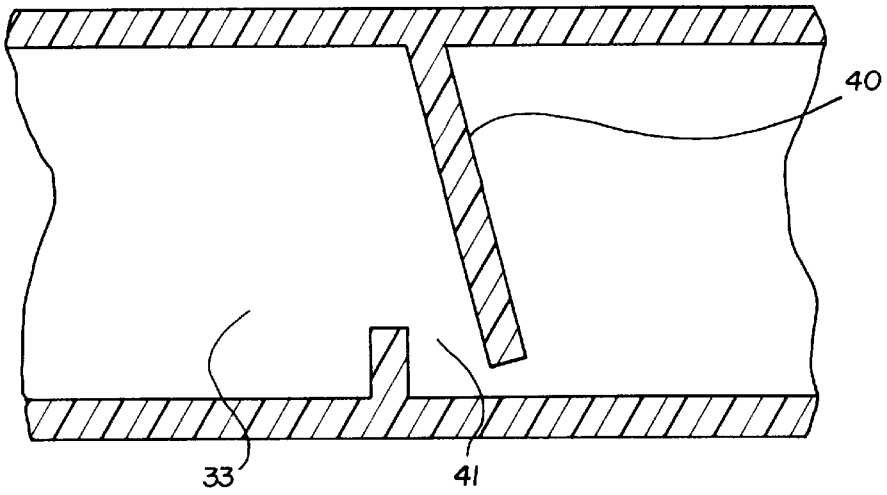

LIQUID DISPENSER FOR CARRYING ON A HEAD

BACKGROUND OF THE INVENTION

1. Field of the Invention

The present invention relates to liquid dispensers and more particularly pertains to a new liquid dispenser for carrying on a head for allowing a user to partake of a liquid without the use of their hands.

2. Description of the Prior Art

The use of liquid dispensers is known in the prior art. More specifically, liquid dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art liquid dispensers include U. S. Pat. No. 4,921,141; U.S. Pat. No. 4,369,782; U.S. Pat. No. 340,344; U.S. Pat. No. 5,148,950; U.S. Pat. No. 4,813,083; and U.S. Pat. No. 4,739,905.

While these devices fulfill their respective, particular objectives and requirements, the aforementioned patents do not disclose a new liquid dispenser for carrying on a head. The inventive device includes a hat with an inner layer and outer layer defining a reservoir for holding a liquid. A tubing is coupled to the hat and in fluid communication with the reservoir. The liquid dispenser for carrying on a head is designed to be worn on a person's head allowing the tubing to be inserted into the wearer's mouth for drawing a liquid from the reservoir.

In these respects, the liquid dispenser for carrying on a head according to the present invention substantially departs from the conventional concepts and designs of the prior art, and in so doing provides an apparatus primarily developed for the purpose of allowing a user to partake of a liquid without the use of their hands.

SUMMARY OF THE INVENTION

In view of the foregoing disadvantages inherent in the known types of liquid dispensers now present in the prior art, the present invention provides a new liquid dispenser for carrying on a head construction wherein the same can be utilized for allowing a user to partake of a liquid without the use of their hands.

The general purpose of the present invention, which will be described subsequently in greater detail, is to provide a new liquid dispenser for carrying on a head apparatus and method which has many of the advantages of the liquid dispensers mentioned heretofore and many novel features that result in a new liquid dispenser for carrying on a head which is not anticipated, rendered obvious, suggested, or even implied by any of the prior art liquid dispensers, either alone or in any combination thereof.

To attain this, the present invention generally comprises a hat with an inner layer and outer layer defining a reservoir for holding a liquid. A tubing is coupled to the hat and in fluid communication with the reservoir. The liquid dispenser for carrying on a head is designed to be worn on a person's head allowing the tubing to be inserted into the wearer's mouth for drawing a liquid from the reservoir.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new liquid dispenser for carrying on a head apparatus and method which has many of the advantages of the liquid dispensers mentioned heretofore and many novel features that result in a new liquid dispenser for carrying on a head which is not anticipated, rendered obvious, suggested, or even implied by any of the prior art liquid dispensers, either alone or in any combination thereof.

It is another object of the present invention to provide a new liquid dispenser for carrying on a head, which may be easily and efficiently manufactured and marketed.

It is a further object of the present invention to provide a new liquid dispenser for carrying on a head which is of a durable and reliable construction.

An even further object of the present invention is to provide a new liquid dispenser for carrying on a head which is susceptible of a low cost of manufacture with regard to both materials and labor, and which accordingly is then susceptible of low prices of sale to the consuming public, thereby making such liquid dispenser for carrying on a head economically available to the buying public.

Still yet another object of the present invention is to provide a new liquid dispenser for carrying on a head which provides in the apparatuses and methods of the prior art some of the advantages thereof, while simultaneously overcoming some of the disadvantages normally associated therewith.

Still another object of the present invention is to provide a new liquid dispenser for carrying on a head for allowing a user to partake of a liquid without the use of their hands.

Yet another object of the present invention is to provide a new liquid dispenser for carrying on a head which includes a hat with an inner layer and outer layer defining a reservoir for holding a liquid. A tubing is coupled to the hat and in fluid communication with the reservoir. The liquid dispenser for carrying on a head is designed to be worn on a person's head allowing the tubing to be inserted into the wearer's mouth for drawing a liquid from the reservoir.

Still yet another object of the present invention is to provide a new liquid dispenser for carrying on a head that supplies a liquid without the use of a bottle or cup.

Even still another object of the present invention is to provide a new liquid dispenser for carrying on a head that allows a user to enjoy an activity and drink a liquid without having to use their hands.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of the tubing of the present invention.

FIG. 6 is a sectional view of a reed type valve in the closed position taken from line 6—6 of FIG. 1.

FIG. 7 is a sectional view of a reed type valve in the open position taken from line 6—6 of FIG. 1.

FIG. 8 is a cross-sectional view of the present invention.

DESCRIPTION OF THE PREFERRED EMBODIMENT

Figure 1:
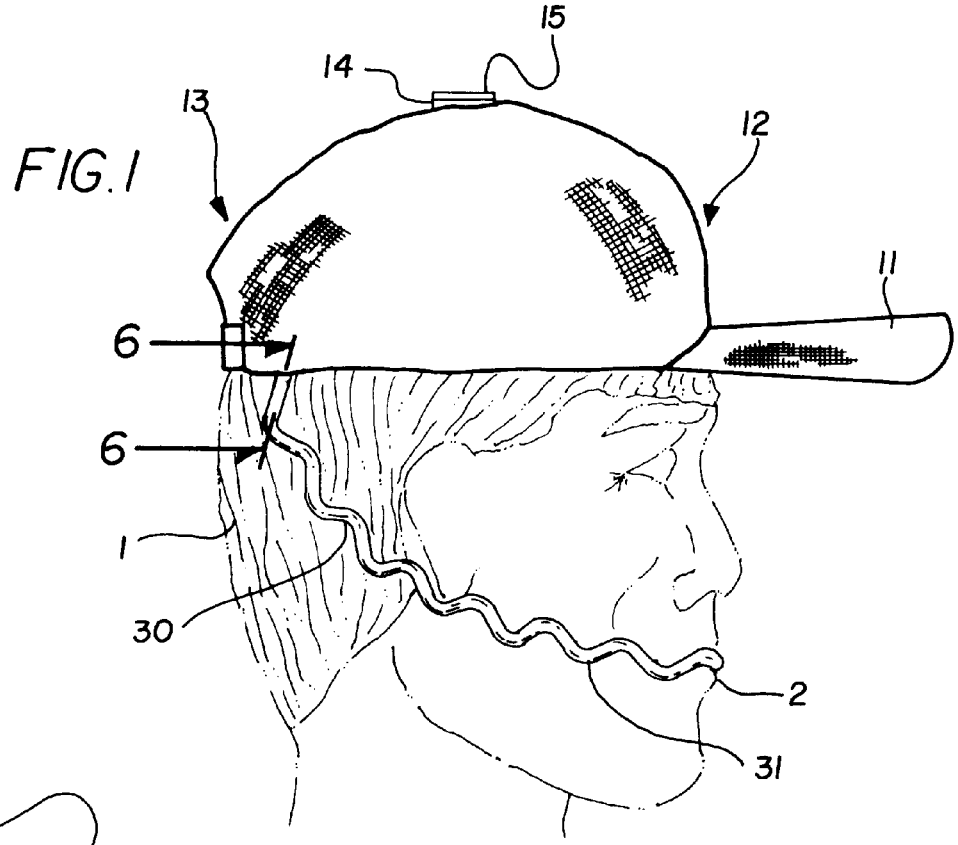
FIG. 1 is a perspective view of a new liquid dispenser for carrying on a headaccording to the present invention.

With reference now to the drawings, and in particular to FIGS. 1 through 8 thereof, a new liquid dispenser for carrying on a head embodying the principles and concepts of the present invention and generally designated by the reference numeral 10 will be described.

As best illustrated in FIGS. 1 through 8, the liquid dispenser for carrying on a head 10 comprises a hat 20 with an inner layer 21 and outer layer 22 defining a reservoir 23 for holding a liquid 16. A tubing 30 is coupled to the hat 20 and in fluid communication with the reservoir 23. The liquid dispenser for carrying on a head 10 is designed to be worn on a person's head 1 allowing the tubing 30 to be inserted into the wearer's mouth 2 for drawing a liquid 16 from the reservoir 23.

The hat 10 has a front region 12 with a brim 11 extending therefrom and a back region 13. A reservoir 23 defined by a collapsible bladder for holding a liquid 16 is formed between the inner 21 and outer 22 layers of the hat 10. The underside of the inner layer 21 also defines a cavity 24 for inserting a person's head 1 therein.

Preferably, a headband 25 is coupled to the inner layer 21. The headband 25 aids in spacing the inner layer 21 from a wearer's head 1 that is inserted into the cavity 24. With the inner layer 21 suspended from the head 1, the amount of heat transfer to the liquid 16 in the reservoir 23 is reduced. Even more preferably, both the inner layer 21 and the outer layer 22 are formed of an insulating material to further reduce the amount of heat transfer through the layers 21,22, such as, for example, by reducing the heat entering the reservoir 23 from the wearer's head 1 or from the overall environment.

The hat 20 has an opening 14 through the outer layer 22. The opening 14 is in fluid communication with the reservoir 23 to thereby permit the filling or emptying of the reservoir 23. Ideally, the opening has a closing means 15, such as a removable lid, to prevent liquid 16 from passing through the opening 14 between filing intervals.

Figure 2:
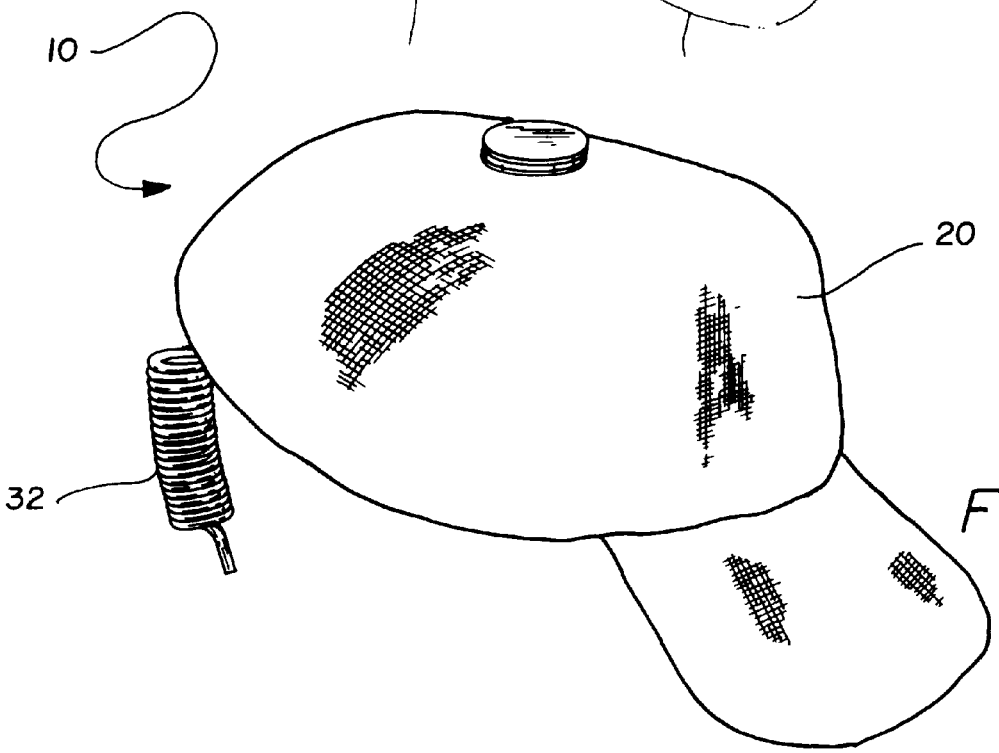
FIG. 2 is a perspective view of the present invention.
Figure 3:
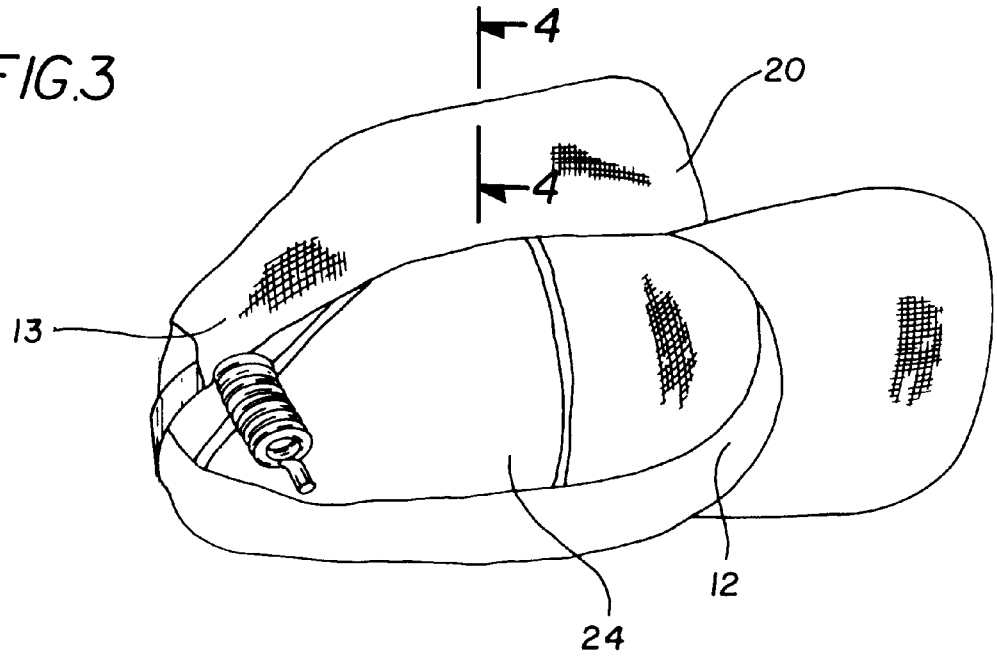
FIG. 3 is a bottom view of the present invention.
Figure 4:
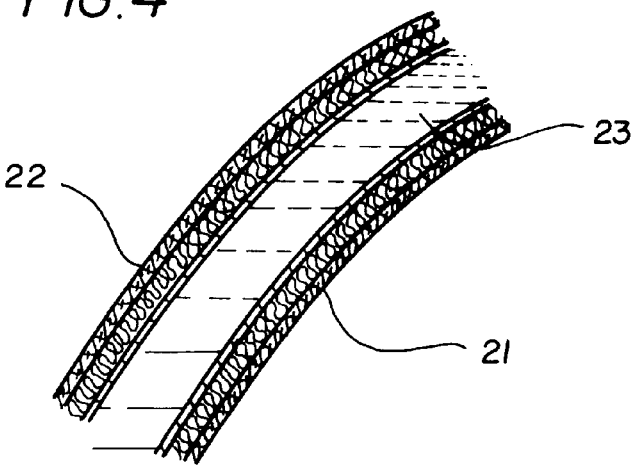
FIG. 4 is a sectional view of the present invention taken from the line 4—4 from FIG. 3.

The tubing 30 is extendible between a retracted position 32, as shown in FIG. 2, and a extended position 31, as shown in FIG. 1. Preferably, the tubing 30 is coiled and biased towards the retracted position 32 to prevent the tubing from dangling and striking the wearer's face during movement by the wearer. Also preferably, the tubing is positioned toward the back region 13 of the hat 20 so as to keep the tubing 30 away from the face during nonuse. The tubing 30 has a hollow interior 33, an open first end 34, and an open second end 35. The open first end 34 is in fluid communication with the interior of the reservoir 23, as shown in FIG. 7. The open second end 35 is for insertion into a mouth 2 for drawing liquid 16 from the reservoir 23 into the wearer's mouth 2.

Ideally, the tubing 30 has a first valve 36 provided within the hollow interior 33. The first valve prevents liquid 16 in the tubing hollow interior 33 from exiting through the open second end 35 when the wearer is not sucking on the tubing 30. Preferably, the first valve 36 is located near or proximate to the open second end 35. The first valve 36, such as, for example, a reed type valve 40, has an open position 41 and a closed position 42. The reed type valve is biased toward the closed position 42 for preventing liquid 16 from passing through the reed type valve 40. The reed type valve 40 is moved toward the open position 41 when a vacuum is applied to the open second end 35 to the hollow interior 33 by the sucking action of the wearer's mouth 2 on the end of the tubing 30.

Preferably, a second valve 37 is provided within the hollow interior 33 at a spaced apart location from the first valve 36 such as at a position between the open first end 34 and the first valve 36. The second valve further prevents liquid 16 from exiting the reservoir 23 and into the tubing hollow interior 33. Preferably, the second valve 37 is located proximate to the open first end 34. Preferably, a reed type valve 40, as described above, can be utilized as a second valve 37.

Preferably, a screen 38 is positioned between the tubing open second end 35 and the first valve 36. The screen 38 prevents relatively large debris from passing through the tubing hollow interior 33 into the wearer's mouth 2.

In use, the closing means 15 is disengaged from the opening 14 and the reservoir 23 is filled with a liquid 16 through the opening 14 of the hat 20. The hat 20 is placed on a person's head 1, preferably with the headband 25 resting on the head 1. The tubing is extended from the retracted position 32 to the extended position 31 and the open second end 35 is inserted into the wearer's mouth 2. The wearer's sucking action, which acts towards the direction of the open second end 35, extracts the liquid 16 from the reservoir 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liquid dispenser for carrying on a head, comprising:

a hat having an inner layer and an outer layer;

a reservoir for holding a liquid being formed between said inner layer and said outer layer;

a cavity being defined by said inner layer, said cavity being for inserting a portion of a person's head therein;

an opening through said outer layer, said opening being in fluid communication with said reservoir, said opening being for permitting filling of said reservoir with a liquid;

a closing means for closing said opening to prevent fluid from passing through said opening;

a length of coiled tubing having a hollow interior, an open first end and an open second end, said coiled tubing open first end being in fluid communication with said reservoir, said coiled tubing being extendible between an extended position and a retracted position, said coiled tubing being biased towards said retracted position, said coiled tubing open second end being for insertion into a wearer's mouth for drawing fluid from said reservoir through said coiled tubing hollow interior into a wearer's mouth;

a first valve being provided within said coiled tubing hollow interior, said first valve permitting flow of a fluid towards said open second end; and a screen being provided within said coiled tubing hollow interior, said screen being positioned towards said coiled tubing open second end, said screen being for preventing debris from passing through said coiled tubing hollow interior.

2. The liquid dispenser of claim 1, wherein said hat has a back region, said coiled tubing open first end being positioned towards said hat back region.

3. The liquid dispenser of claim 1, further comprising a brim, and wherein said hat has a front region, said brim being extended from said hat front region.

4. The liquid dispenser of claim 1, wherein said inner layer is insulated to help reduce heat transfer through said inner layer, and wherein said outer layer is insulated to help reduce heat transfer through said outer layer.

5. The liquid dispenser of claim 1, wherein said closing means includes a lid for closing said opening to prevent fluid from passing through said opening.

6. The liquid dispenser of claim 1, further comprising a second valve being provided within said coiled tubing hollow tubing, said second valve permitting flow of a fluid towards said open second end of said coiled tubing.

7. The liquid dispenser of claim 6, wherein said second valve is spaced apart from said first valve, said second valve being positioned within said coiled tubing hollow interior between said coiled tubing open first end and said first valve.

8. The liquid dispenser of claim 1, wherein said first valve is positioned towards said coiled tubing open second end.

9. The liquid dispenser of claim 8, wherein said screen is positioned between said coiled tubing open second end and said first valve.

10. The liquid dispenser of claim 1, further comprising a head band being provided within said cavity, said head band being coupled to said inner layer, said head band being for suspending said inner layer from a head inserted into said cavity.

11. A liquid dispenser for carrying on a head, comprising:

a hat having a back region, a front region, an inner layer, and an outer layer, said inner layer being insulated to help reduce heat transfer through said inner layer, said outer layer being insulated to help reduce heat transfer through said outer layer;

a reservoir for holding a liquid being formed between said inner layer and said outer layer;

a brim being extended from said hat front region;

a cavity being defined by said inner layer, said cavity being for inserting a portion of a person's head therein;

a head band being provided within said cavity, said head band being coupled to said inner layer, said head band being for suspending said inner layer from a head inserted into said cavity;

an opening through said outer layer, said opening being in fluid communication with said reservoir, said opening being for permitting filling of said reservoir with a liquid;

a lid for closing said opening to prevent fluid from passing through said opening;

a length of coiled tubing having a hollow interior, an open first end and an open second end, said coiled tubing open first end being positioned towards said hat back region, said coiled tubing open first end being in fluid communication with said reservoir, said coiled tubing being extendible between an extended position and a retracted position, said coiled tubing being biased towards said retracted position, said coiled tubing open second end being for insertion into a wearer's mouth for drawing fluid from said reservoir through said coiled tubing hollow interior into a wearer's mouth;

a first valve being provided within said coiled tubing hollow interior, said first valve being positioned towards said coiled tubing open second end said first valve permitting flow of a fluid towards said open second end of said coiled tubing;

a second valve being provided within said coiled tubing hollow interior, said second valve being spaced apart from said first valve, said second valve being positioned within said coiled tubing hollow interior between said coiled tubing open first end and said first valve, said second valve permitting flow of a fluid towards said open second end of said coiled tubing; and a screen being provided within said coiled tubing hollow interior, said screen being positioned between said coiled tubing open second end and said first valve, said screen being for preventing debris from passing through said coiled tubing hollow interior.

* * * * *